United States Patent [19]

Braillard

[11] 4,063,312

[45] Dec. 20, 1977

[54] BUTTON SECURING DEVICE

[76] Inventor: Pierre Braillard, 29 rue de la Coulouvreniere, 1211 Geneva 11, Switzerland

[21] Appl. No.: 699,153

[22] Filed: June 23, 1976

[30] Foreign Application Priority Data

June 26, 1975 Switzerland ..... 8342/75
Feb. 25, 1976 Switzerland ..... 2314/76

[51] Int. Cl.[2] ..... D05B 3/14

[52] U.S. Cl. ..... 2/265; 24/90 TA; 24/90 R

[58] Field of Search ..... 24/90 TA, 90 W, 90 PR, 24/90 TS, 90 F, 90 G, 103, 101 R, 101 FS, 102 A, 16 PB, 30.5 P, 90 E; 2/26 S

[56] References Cited

U.S. PATENT DOCUMENTS 3,349,447 10/1967 Raleigh ..... 24/90 W
3,894,317 7/1975 Nysten ..... 24/90 W
3,900,925 8/1975 La Torvaca ..... 24/90 W
3,925,855 12/1975 Olovson ..... 24/90 PR

FOREIGN PATENT DOCUMENTS 2,409,145 9/1974 Germany ..... 24/90 TA

*Primary Examiner*—G. V. Larkin
*Attorney, Agent, or Firm*—Robert E. Burns; Emmanuel J. Lobato; Bruce L. Adams

[57] ABSTRACT

A button-securing device comprises a spacing piece having flat opposite faces holding a button spaced apart from a fabric. An integral, flexible elongate attachment extends from the piece to a pointed end with fixing barbs. This attachment can be brought to a looped button-securing configuration by passing it through openings in the button, through the fabric, and back through the fabric into an opening in the spacing piece where it is held.

10 Claims, 7 Drawing Figures

FIG. 1
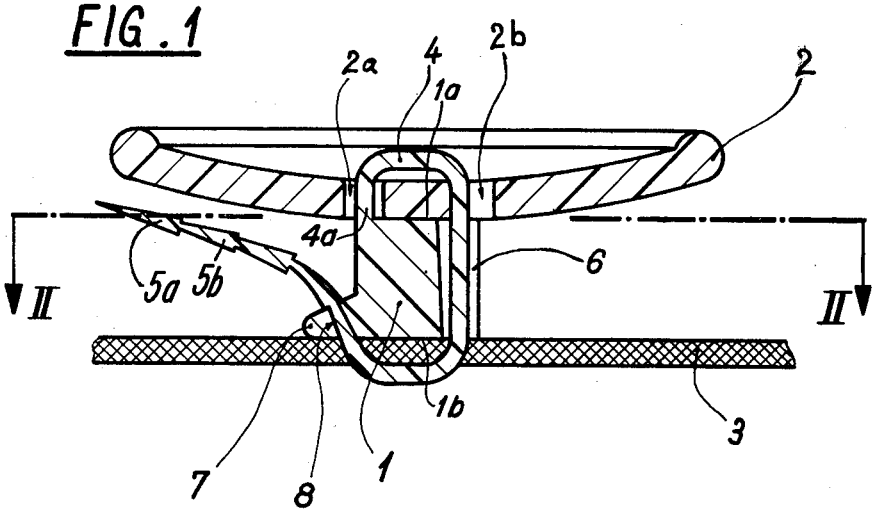
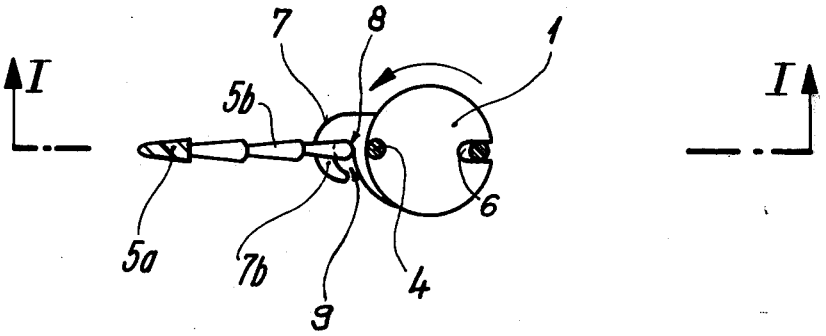
FIG. 2

BUTTON SECURING DEVICE

BACKGROUND OF THE INVENTION

The invention relates to the securing of buttons onto fabrics or similar surfaces.

Various devices have already been proposed for securing buttons without sewing or using a needle and thread.

For example, a known device comprises a flexible attachment having a central part arranged to be looped through openings in a button, this central part being limited by two shoulders which can be brought together and made to apply on an outer face of a fabric. These shoulders are extended by pointed barbed ends which can be brought together and pierced through a fabric into an opening in a backing plate, so that the fabric is gripped between said shoulders and the backing plate. This device has the advantage of providing a desired spacing between the button and the fabric. However, although the device provides a satisfactory securing of buttons, it involves two drawbacks: firstly, the bringing together of the two ends of the attachment to form a "needle" which is passed through the fabric is a tedious operation; secondly, it necessarily involves the use of a separate backing plate which can inconvenience the wearer of a garment who secures a button in this manner.

In another known device, a backing plate is made integrally with a thread whose end is pointed to form a needle. The needle/thread is passed through the fabric, then through openings or a loop of a button, back through the fabric, then attached in any manner to the backing plate and its end is cut off. This device has the advantage of being formed in a single piece, for example by moulding. However, it has the disadvantages that there is no provision for ensuring a predetermined spacing between the fabric and the button, the fabric is not firmly gripped against the backing plate, and the rigid backing plate behind the fabric is inaesthetic and may inconvenience the wearer of a garment who secures a button using this device.

The invention aims to obviate the disadvantages of the known devices and to enable the securing of a button, without using a needle and thread, with a suitable spacing from a fabric but without creating any appreciable added thickness on the inside of the fabric.

SUMMARY OF THE INVENTION

According to the invention, there is provided a button-securing device for securing a button having at least two openings or a loop onto a fabric or the like surface, comprising a spacing piece having opposite parallel faces for contacting a button and a fabric, at least one integral flexible attachment extending from the spacing piece, and an opening in the spacing piece for receiving and holding the attachment in a looped button-securing configuration, i.e. with the attachment passed through the openings of the button, through one side of the fabric, back through the other side of the fabric and through the opening in the spacing piece where it is firmly held.

BRIEF DESCRIPTION OF THE DRAWINGS

Embodiments of the invention will be described by way of example, with reference to the accompanying drawings, in which:

FIG. 1 is a cross-section, along line I—I of FIG. 2, of a first embodiment of the invention, shown securing a button on a fabric;

FIG. 2 is a cross-section along line II—II of FIG. 1;

DESCRIPTION OF THE PREFERRED EMBODIMENTS

Figure 3:
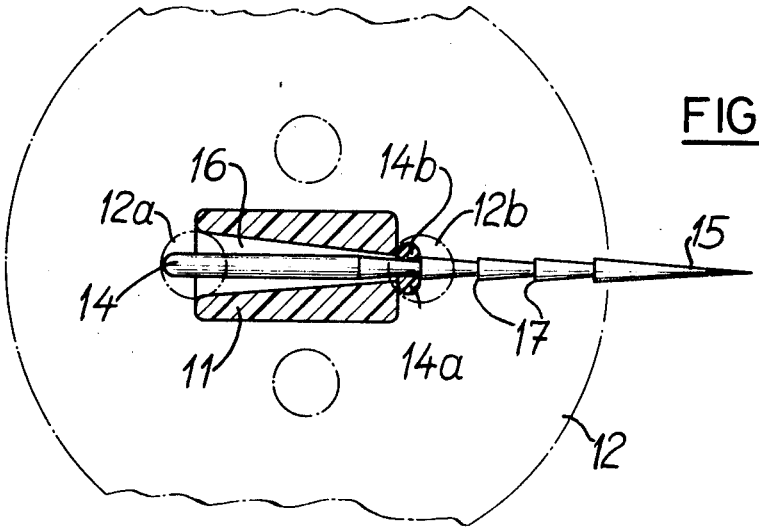
FIG. 3 is a cross-section, along line III—III of FIG. 4, of a second embodiment.

With reference to FIGS. 1 and 2, a generally cylindrical spacing piece 1 has flat opposite parallel faces or end surfaces 1*a*, 1*b*, on one of which a button 2 comes to rest, and the other of which bears on a fabric 3. The button 2 has two openings 2*a*, 2*b* through which passes a flexible elongate attachment member 4, integrally secured to the piece 1 at on attachment portion 4*a*. The attachment 4 as shown extends perpendicularly from one edge of the upper, upwardly openly exposed face 1*a* of piece 1, which contacts button 2, to a pointed end 5*a* adjacent which are several barbs 5*b*.

Diametrally opposite the location of the junction of attachment 4, the piece 1 has a lateral groove 6 extending along the entire length of the piece 1 between its flat opposite end faces.

The lower face downwardly openly exposed portion of piece 1, which applies against the tissue 3, is extended, diametrally opposite to groove 6, by a shoulder or protuberance 7 which can be about semicylindrical as shown at 7*a*. In this protuberance is a lateral groove 8, oblique to the plane of fabric 3, extending from the lower face 1*b* to the top of the protuberance, and which laterally opens at 9 to the exterior to define, in the protuberance 7, an elastically-deformable curved tongue 7*b*.

To secure a button 2 on a fabric 3 by this device, the attachment 4 is passed through the openings 2*a* and 2*b* of the button 2 and placed in the guide groove 6. Then the pointed end 5*a* is pierced through the fabric 3, pulled through, and pierced back through the fabric 3 at a suitable location so that, by pivoting the button 2 and piece 1 about the pivoting axis formed by the part of the attachment 4 extending through the opening 2*b*, groove 6 and into the fabric 3, the end part of the attachment 4 protruding from the fabric 3 can be received in the slot 8 by elastic deformation of tongue 7*b*. The barbs 5*b* prevent the attachment 4 from sliding back through the slot 8. Finally, the end part of the attachment 4 protruding beyond protuberance 7*a* can be cut off.

Figure 5:
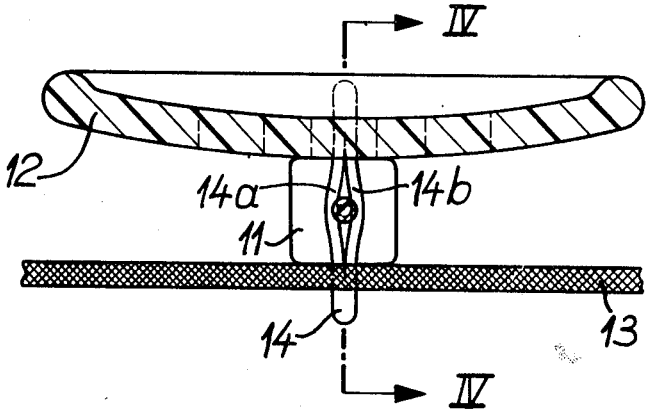
FIG. 5 is a cross-section along line V—V of FIG. 4.

With reference to FIGS. 3 and 5, a spacing piece 11 of generally rectangular section is disposed between a button 12 and a fabric 13 which bear against flat, mutually opposite, parallel, upwardly and downwardly openly exposed faces of piece 11. Button 12 includes two openings 12*a*, 12*b*. A flexible elongate attachment 14, integral with piece 11, extends perpendicularly from the middle of one of the edges of the face of piece 11 which is in contact with the button 12.

The piece 11 has a tapered through-opening 16 extending, with its axis parallel to the said opposite faces of piece 11, from the middle of a first side of piece 1, below the junction of attachment 14 to a second and opposite side of piece 11.

The attachment 14 has a pointed end 15 adjacent which are a series of barbs 17 and, in its middle part extending along the second side, is split into two braches 14*a*, 14*b*.

In use, the pointed end 15 of attachment 14 is passed through the openings 12*a* and 12*b* of button 12, then through fabric 13, under the fabric 13 past the face of piece 11 in contact with the other side of the fabric, and back through the fabric 13 at a suitable location to be passed through the opening 16 and through the slit between branches 14*a*, 14*b* of the attachment, so that the barbs 17 prevent return of the attachment. By pulling on the pointed end 15 of attachment 14, the button 12 can be tightened against the piece 11 and the piece 11 against fabric 13. The final barb 17 having passed through the slit part of attachment 14 is locked against the branches 14*a*, 14*b* when the pointed end 15 is released, so that the device is firmly secured in place. Finally, the protruding end part of the attachment 14 can be cut off.

Figure 6:
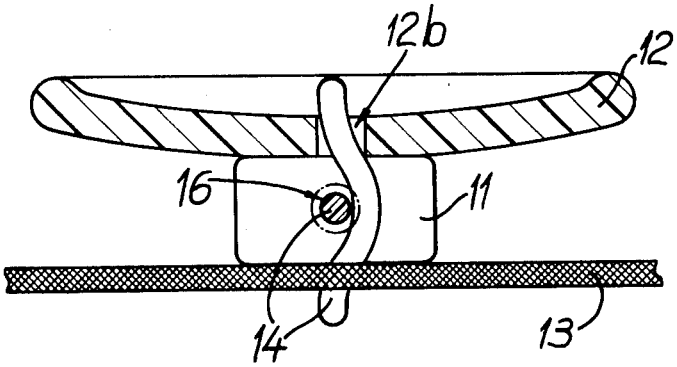
FIG. 6 is a view similar to FIG. 5 of a variation.

FIG. 6 shows a variation of the second embodiment, in which the attachment 14 is not split. When the attachment 14 is passed through the opening 16 of piece 11, the pointed end of the attachment pushes the portion of the attachment 14 between the opening 12*b* and fabric 13 towards the right, as shown in FIG. 6. In this variation, the barbs on the end part of the attachment engage against said portion of the attachment 14, which portion also urges the barbed part of the attachment 14 towards the left (FIG. 6) so that it jams on the face of piece 11 adjacent opening 16. Alternatively, the barbs of the attachment could pass through the narrow end of opening 16 with an elastic deformation. of the barbs or of the edge parts of the piece 11 about the narrow end of opening 16 or of both, and then be prevented from returning by one of the barbs which bears against the corresponding face of piece 11. Elasticity of the edge parts of piece 11 could be increased by providing a slit in the corresponding face of piece 11 through opening 16.

Figure 4:
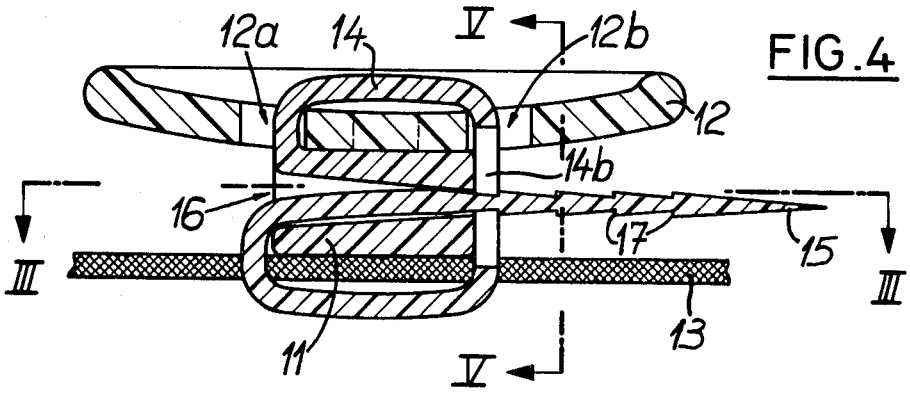
FIG. 4 is a cross-section, along line IV—IV of FIG. 5; showing the second embodiment securing a button on a fabric.
Figure 7:
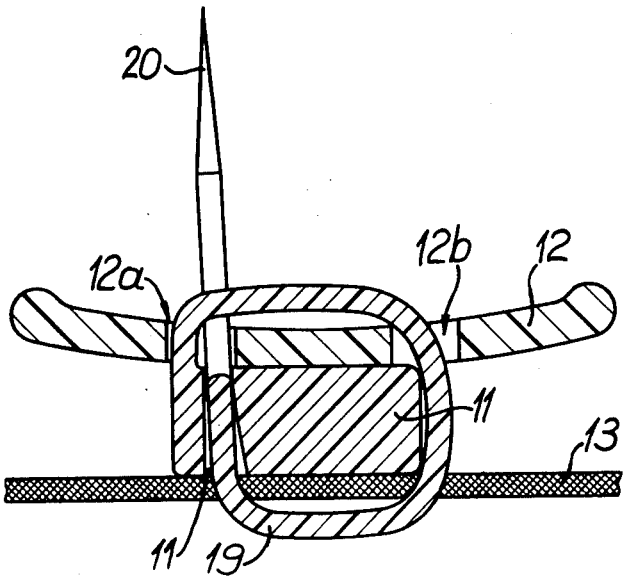
FIG. 7 is a view, similar to FIGS. 1 and 4, of a third embodiment.

In the embodiment of FIG. 7, a spacing piece 11', which may have any suitable sectional shape such as circular or generally rectangular, has a flexible elongate attachment 19 which extends from an edge of the face of piece 11' on which button 12 rests, up to a pointed free end 20. A tapered conical opening 21 through the piece 11' extends from its face which contacts fabric 13 to its face which contacts button 12, adjacent the junction of attachment 19. In use, the attachment 19 is passed through openings 12*a* and 12*b* of button 12, through the fabric 13 near one of the edges of piece 11', and then back through the fabric 13 directly into and through the opening 21 from which its pointed end 20 emerges via the opening 12*a* of the button. The attachment is held in place by barbs (not shown) as described for FIG. 6 or, alternatively, through a split or slotted part of the attachment 19, as for FIGS. 3,4 and 5.

In any of the described embodiments, it is possible to weld the attachment after it has been tautened, at the moment when the redundant pointed end part is cut off, or to form an enlarged head by plastic deformation of the remaining end part of the attachment.

Devices according to the invention can be mass produced at low cost, since the device consists of a single piece which can for example be moulded in coloured or transparent plastics materials.

The devices are very simple to handle and are efficient for replacing buttons whose securing threads have broken.

The device is also suitable for the industrial fitting of buttons at a very high rate. For example a button and spacing piece combination with the attachment already passed through orifices of the button can be placed on a fabric, fixed and welded in several seconds or less.

The described devices can be used not only for buttons with two or more openings, but also for buttons with a securing loop; the first embodiment is the most suitable for buttons of this type.

For some applications, the spacing pieces could be provided with two attachments and two openings for receiving the attachments: for example, one attachment for securing a button on the spacing piece and another attachment for securing the spacing piece on a fabric. The first embodiment (FIGS. 1 and 2) could for example be modified by having a first attachment extending from one face, i.e. that placed against the fabric, this first attachment cooperating with a channel in a protuberance such as *7a*, and a second attachment extending from the other face, i.e. that placed against the button, this second attachment cooperating with a channel in a similar protuberance forming a shoulder with said other face.

In all of the described embodiments, instead of having barbs, the attachments could have bulges of other form adjacent the pointed end, for the purpose of securing the attachment in the looped button-securing configuration.

Also, the spacing piece could be formed of two or more parts assembled together, the or each attachment being integral with one of the parts of the piece.

What is claimed is:

1. A button-securing device comprising; a button-spacing piece having two mutually opposite, parallel, openly exposed faces, one for contacting a button and the other for contacting a fabric; and a flexible elongate attachment number integrally extending from an attachment portion of the button spacing piece, the button-spacing piece having an opening for receiving an end portion of the attachment member remote from the attachment portion and for holding the so-received attachment in a looped configuration to secure the so-contacted button to the so-contacted fabric.

2. A device according to claim 1, in which the spacing piece has a protuberance outwardly extending therefrom and providing a shoulder extending from one of said faces, said opening being a channel in the protuberance.

3. A device according to claim 2, in which the protuberance has an elastically-deformable tongue defining the channel.

4. A device according to claim 1, in which the attachment member extends from the face of the spacing piece for contacting the button, and the shoulder extends from the face of the spacing piece for contacting the fabric.

5. A device according to claim 4, in which the spacing piece has a lateral groove recessed into a side thereof and extending from one of the mutually opposite faces to the other for receiving and guiding the attachment member in its looped button-securing configuration.

6. A device according to claim 1, in which the opening extends through the spacing piece from one portion thereof to an opposite portion thereof between the mutually opposite faces.

7. A device according to claim 6, in which the opening extends from one to another side of the spacing piece, in a direction generally parallel to the mutually opposite faces.

8. A device according to claim 6, in which the opening extends in a direction generally perpendicular to and through the opposite faces of the spacing piece.

9. A device according to claim 6, in which the attachment has a barbed portion, remote from the attachment portion, and the opening is tapered to facilitate insertion and retention of the barbed portion.

10. A device according to claim 1, in which the attachment member consists of a material which can be permanently deformed in the vicinity of the opening to firmly hold the attachment member in its looped button-securing configuration.

* * * * *